US009970660B2

(12) United States Patent
Chandler et al.

(10) Patent No.: US 9,970,660 B2
(45) Date of Patent: May 15, 2018

(54) LINER ELEMENT FOR A COMBUSTOR

(71) Applicant: ROLLS-ROYCE PLC, London (GB)

(72) Inventors: Paul I Chandler, Birmingham (GB); Anthony Pidcock, Derby (GB)

(73) Assignee: ROLLS-ROYCE plc, London (GB)

( * ) Notice: Subject to any disclaimer, the term of this patent is extended or adjusted under 35 U.S.C. 154(b) by 414 days.

(21) Appl. No.: 14/789,322

(22) Filed: Jul. 1, 2015

(65) Prior Publication Data

US 2016/0025345 A1 Jan. 28, 2016

(30) Foreign Application Priority Data

Jul. 25, 2014 (GB) ..... 1413194.0

(51) Int. Cl.
*F23R 3/10* (2006.01)
*F23R 3/00* (2006.01)
*F23R 3/60* (2006.01)

(52) U.S. Cl.
CPC ..... *F23R 3/10* (2013.01); *F23R 3/002* (2013.01); *F23R 3/60* (2013.01); *F23R 2900/03041* (2013.01)

(58) Field of Classification Search
CPC .... F23R 3/10; F23R 3/002; F23R 3/60; F02C 7/20; F02C 1/00
See application file for complete search history.

(56) References Cited

U.S. PATENT DOCUMENTS 4,085,580 A 4/1978 Slattery
5,265,411 A 11/1993 Belsom
5,435,139 A 7/1995 Pidcock et al.
8,262,802 B2 9/2012 Garry et al.
2008/0264065 A1* 10/2008 Gerendas ..... F23R 3/002 60/754
2010/0263386 A1 10/2010 Edwards et al.
2011/0030378 A1* 2/2011 Carlisle ..... F23R 3/002 60/753

FOREIGN PATENT DOCUMENTS

EP 1467151 A1 10/2004
EP 1635118 A2 3/2006
EP 1741981 A1 1/2007
GB 647302 A 12/1950
GB 2432902 A 6/2007

OTHER PUBLICATIONS

Dec. 10, 2015 Search Report issued in European Patent Application No. 15174882.
Jan. 21, 2015 Search Report issued in British Patent Application No. 1413194.0.

* cited by examiner

*Primary Examiner* — Craig Kim
(74) *Attorney, Agent, or Firm* — Oliff PLC

(57) ABSTRACT

There is disclosed a liner element in the form of an impingement/effusion tile for a gas turbine combustor having a structural wall. The liner element has a unitary construction defining a cooling side and combustion side, and a plurality of effusion holes extending between a cooling side surface of the element and a combustion side surface of the element. The liner element is configured to be affixed to the structural wall of a combustor with its cooling side surface spaced from the structural wall to define a chamber between the cooling side surface and the structural wall, and the liner element further includes integrally formed and internally threaded protuberances on its cooling side, the protuberances being arranged to engage the structural wall.

18 Claims, 4 Drawing Sheets

LINER ELEMENT FOR A COMBUSTOR

The present invention relates to a liner element for a gas turbine combustor.

The combustion process which takes place within the combustor of a gas turbine engine results in the combustor walls being exposed to extremely high temperatures. The alloys which are typically used in combustor wall construction are normally unable to withstand these temperatures without some form of cooling arrangement. It is therefore known to make use of pressurised air derived from the engine's compressor for cooling purposes within the combustor.

One way of cooling the combustor wall with compressor air in this manner involves the provision of a double wall combustor construction having a continuous outer wall and an inner wall made up of a number of separate and replaceable wall elements in the form of tiles which are affixed to the outer wall in a tessellated manner. The inner wall tiles are each configured to be affixed to the outer wall of the combustor so as to define a chamber between a cooling side surface of the tile and the outer wall. The outer wall is provided with a number of feed holes through which cooling air drawn from the engine's compressor is directed so as to pass into the chambers defined between each inner tile and the outer wall, for impingement on the aforementioned cooling side surface of the inner tile, thereby providing impingement cooling to the inner tile. The inner tiles are each furthermore provided with a plurality of so-called effusion holes which define flow passages through the tiles from their cooling side surfaces to oppositely directed combustion side surfaces which face the interior of the combustor where combustion will take place during operation of the engine. The cooling air which is directed into the chambers and which impinges on the cooling side surface of the tiles is thus exhausted through the effusion holes and in doing so provides convective heat removal from the tiles. The air subsequently forms a thin film of air over the tiles' combustion side surfaces which helps to protect the tiles from the combustion flame inside the combustor. In order to aid the formation of this thin film of air, the effusion holes are often inclined relative to the combustion side surface. Combustor wall arrangements of the type described above thus provide both impingement and effusion cooling of the combustor wall construction, and the tiles are sometimes referred to as impingement/effusion ("IE") tiles.

U.S. Pat. No. 5,435,139 describes a tile system of the general type described above. This document also shows how the tiles are typically affixed to the outer wall of the combustor. Each tile has a number of integrally-formed threaded studs which protrude outwardly from the cold side of the tile and which are received through respective apertures formed in the outer wall of the combustor and engaged by respective self-locking nuts on the outer side of the outer wall.

Tiles of the type described above are typically formed from a nickel based alloy, and have their combustion side surfaces protected by a thermal barrier coating to insulate the tile and thereby maintain the temperature of the metal within acceptable levels.

The thermal barrier coating is usually applied in two parts: an initial bond coat (such as a CoNiCrAly composition); and a thermally insulating top coat which may comprise Yttria Partially Stabilised Zirconia ("PYSZ") and which is applied over the bond coat. The bond coat is applied directly to the metal of the tiles, for example by air plasma spray, to ensure adherence of the subsequent top coat. The bond coat may typically have a thickness of between 0.05 mm and 0.2 mm, whilst the top coat usually has a thickness of between 0.1 mm and 0.5 mm.

As will be appreciated, it is important for proper functioning of the tiles that their effusion holes are not blocked by the application of the thermal barrier coating. This represents a significant technical challenge, and various processes have been proposed in the prior art to prevent effusion hole blockage.

One such process, known as a so-called "coat-drill" process involves applying the thermal barrier coat to the combustion side surface of a tile, and then subsequently forming the effusion holes through both the alloy of the tile and the coating. This usually involves forming the holes either by mechanical drilling or by laser from the combustion side, firstly through the thermal barrier coating and then through the metal of the tile. Although this process is relatively simple, in the case of laser-cutting the effusion holes the laser must be operated at reduced power to avoid excessive damage to the brittle ceramic thermal barrier coating. Reducing the power of the cutting laser increases the cycle time necessary to form the holes which can significantly increase the production cost of the tiles. Furthermore, forming the effusion holes through the thermal barrier coating can cause cracking and delamination in the coating which can lead to premature loss of the coating during service, resulting in potential thermal damage to the tiles.

Alternatively, it is possible to form the effusion holes through the tile before the thermal barrier coating is then applied. This process, known as a so-called "drill-coat" process, is also relatively simple and has the benefit of allowing full-power operation of a cutting laser to form the effusion holes. However an inevitable consequence of this process is that some or all of the effusion holes then become either partially or completely blocked by the thermal barrier coating when it is applied. These blockages reduce the effective flow area of the tile and thus have a deleterious effect on convective heat removal within the effusion holes and the formation of a cooling film of air across the combustion side surface of the tile during service.

It is therefore considered preferable to use a so-called "drill-coat-clean" process, which is basically similar to the "drill-coat" process but which includes a subsequent cleaning process effective to clean the effusion holes to remove any coating material blocking the effusion holes. This cleaning step can be done via the use of a high pressure water or air jet, which may contain abrasive particles, and which is directed towards and through the holes to blast out any coating material therefrom. The water or air jet is usually directed towards the effusion holes from the cooling side of the tile. U.S. Pat. No. 8,262,802 discloses this type of technique.

A cleaning step of the type described above, carried out either after the entire thickness of the thermal barrier coating has been applied or as an intermediate step carried out after the initial bonding layer has been applied, has been found to provide clean effusion holes with slightly rounded edges. Also, the thermal barrier coating remains free from cracks and delamination which can arise via use of a laser to cut the holes after application of the coating.

However, in the specific context of a combustor liner tile, it can be difficult to direct the cleaning jet properly at all of the effusion holes because of obstruction by the attachment studs which project outwardly from the cold side of the tile. This problem is illustrated schematically in FIG. 1 which shows an IE tile 1 having a cooling side 2 and a combustion side 3. The cooling side 2 of the tile defines a cooling side surface 4, and the combustion side 3 of the tile defines a combustion side surface 5 which in use will be directed to the region of a combustor in which combustion will take place. The effusion holes 6 can be seen to extend between the cooling side surface 4 and the combustion side surface 5 at an inclined angle to the combustion side surface 5. FIG. 1 also illustrates a pair of externally threaded attachment studs 7 of the type described above in the prior art, which protrude from the cooling side 2 of the tile for receipt through respective apertures formed in the outer wall of a combustor (not shown). As will be appreciated, the attachment studs must have sufficient length to extend across the cavity which will be formed between the cooling side surface 4 of the tile and the outer wall of the combustor, and then project through the apertures in the outer wall by a sufficient degree to engage a threaded nut. A typical IE tile may have up to eight attachment studs 7 of this type, provided in spaced-apart relation to one another over the cooling side of the tile.

FIG. 1 also shows a cleaning nozzle 8 which is used to direct a jet of cleaning water or air towards the effusion holes 6 as illustrated, in order to clean the effusion holes of any coating material that may collect therein during the step of applying a thermal barrier coating to the combustion side surface 5 as described above. The nozzle 8 is positioned to direct a jet along a jet axis 9 towards each effusion hole 6, the jet axis 9 being inclined relative to the combustion side surface 5 by the same angle as the effusion holes so that the jet is directed through the holes. The nozzle 8 may be moved across the cooling side of the tile 1, for example in a scanning manner, to direct its cleaning jet though successive effusion holes.

However, it has been found that the length of the attachment studs 7, which can typically be approximately 15 mm, obstructs the nozzle 8 and can therefore prevent effective cleaning of the effusion holes 6. In order to clean the effusion holes effectively it has been found that the nozzle 8 should be spaced from the cooling side surface 4 by a distance of approximately 30 mm or less, as measured along the jet axis 9. The length of the attachment studs 7 precludes this because clashes occur between the nozzle 8 and the studs 7 as the nozzle is moved across the cooling side 2 of the tile at a range of anything less than 50 mm measured along the jet axis 9. Also the length of the studs 7 can also preclude the jet being properly directed towards several effusion holes proximate to each stud, those holes thus effectively sitting in the "shadow" of the studs.

Another problem which arises from the prior art configuration of the attachment studs 7 is that they represent a limiting factor in the efficiency with which the IE tiles can be manufactured by a Direct Laser Deposition ("DLD") technique. DLD is a type of additive layer manufacturing technique which is considered to be advantageous for the production of IE tiles from their base alloy because it allows all features of the tiles, including the effusion holes and the attachment studs, to be formed integrally in a single process. In order to maximise the number of tiles which can be produced simultaneously via a DLD process it is optimal to form the tiles in a vertically stacked array on the DLD machine bed. However, it has been found that this orientation often produces an unacceptable quality of threads on the attachment studs of the tiles. Improved threads can be obtained by forming the tiles in a horizontally arranged array, but in this orientation the number of tiles which can be formed simultaneously in any given DLD machine is significantly reduces, which thus increases the production cost per tile.

It is an object of the present invention to provide an improved liner element for a gas turbine combustor.

According to the present invention, there is provided a liner element for a gas turbine combustor having a structural wall, the liner element having a unitary construction defining a cooling side and a combustion side, and a plurality of effusion holes extending between a cooling side surface of the liner element and a combustion side surface of the liner element; the liner element being configured to be affixed to the structural wall of a combustor with its cooling side surface spaced from the structural wall to define a chamber between the cooling side surface and the structural wall, wherein the liner element further includes integrally formed and internally threaded protuberances on its cooling side, the protuberances being spaced from the cooling side surface, the protuberances being arranged to engage the structural wall.

Preferably, each protuberance is provided in the form of a boss projecting from the cooling side of the liner element.

Conveniently, the liner element has a peripheral flange configured to engage said structural wall of the combustor when the liner element is affixed thereto, wherein at least some of said protuberances project from said flange.

Said protuberances projecting from the flange may protrude by a distance of between 2 mm and 8 mm and may, for example protrude by a distance of approximately 5 mm.

The peripheral flange may support at least one tab, each tab extending inwardly from the periphery of the liner element towards the centre of the liner element, each tab being spaced from the cooling side surface and each tab supporting a protuberance which extends away from the cooling side surface of the liner element.

Optionally, the liner element may have at least one centrally located web projecting from said cooling side surface, the or each said web supporting a said protuberance.

Conveniently, said effusion holes define respective flow channels through the liner element having respective axes which are inclined relative to said combustion side surface.

Optionally, some of said effusion holes are proximate to said protuberances and are larger than other effusion holes which are distal to said protuberances.

Some of said effusion holes may be provided underneath at least one of the protuberances. The effusion holes may have respective axes which are arranged perpendicularly to said combustion side surface.

The liner element may be provided in combination with a said gas turbine combustor, wherein the liner element is affixed to the structural wall of the combustor by a plurality of threaded bolts, each bolt extending through a respective fixing aperture formed in the structural wall and threadedly engaging a respective protuberance.

Preferably, each protuberance is engaged within a respective said fixing aperture.

Conveniently, each protuberance projects through a respective said fixing aperture.

At least one of the threaded bolts may have a centrally located passage, the centrally located passage extends the full length of the threaded bolt and the corresponding protuberance has a bore which extends completely though the protuberance.

According to a second aspect of the present invention, there is provided a gas turbine combustor having a structural wall and a liner element, the liner element having a unitary construction defining a cooling side and a combustion side, a plurality of effusion holes extending between a cooling side surface of the liner element and a combustion side surface of the liner element; the liner element being affixed to the structural wall of the combustor with its cooling side surface spaced from the structural wall to define a chamber between the cooling side surface and the structural wall, wherein the liner element includes a peripheral flange configured to engage said structural wall of the combustor when the liner element is affixed thereto, the liner element further includes integrally formed and internally threaded protuberances on its cooling side, the protuberances being spaced from the cooling side surface, the protuberances being arranged to engage the structural wall, wherein at least some of said protuberances project from said flange, the liner element is affixed to the structural wall of the combustor by a plurality of threaded bolts, each bolt extending through a respective fixing aperture formed in the structural wall and threadedly engaging a respective protuberance.

Some of said effusion holes may be provided underneath at least one of the protuberances, the at least one protuberance has a bore which extends completely though the protuberance, the corresponding threaded bolt has a centrally located passage and the centrally located passage extends the full length of the threaded bolt.

According to a third aspect of the present invention, there is provided a gas turbine combustor having a structural wall and a liner element, the liner element having a unitary construction defining a cooling side and a combustion side, a plurality of effusion holes extending between a cooling side surface of the liner element and a combustion side surface of the liner element; the liner element being affixed to the structural wall of the combustor with its cooling side surface spaced from the structural wall to define a chamber between the cooling side surface and the structural wall, wherein the liner element includes a peripheral flange configured to engage said structural wall of the combustor when the liner element is affixed thereto, the liner element further includes integrally formed and internally threaded protuberances on its cooling side, the protuberances being spaced from the cooling side surface, the protuberances being arranged to engage the structural wall, at least one centrally located web projecting from said cooling side surface, the or each said web supporting a said protuberance, the liner element is affixed to the structural wall of the combustor by a plurality of threaded bolts, each bolt extending through a respective fixing aperture formed in the structural wall and threadedly engaging a respective protuberance.

Some of said effusion holes may be provided underneath at least one of the protuberances, the at least one protuberance has a bore which extends completely though the protuberance, the corresponding threaded bolt has a centrally located passage and the centrally located passage extends the full length of the threaded bolt.

The at least one centrally located web may be configured to engage said structural wall of the combustor when the liner element is affixed thereto.

So that the invention may be more readily understood, and so that further features thereof may be appreciated, embodiments of the invention will now be described by way of example with reference to the accompanying drawings in which.

Figure 1:
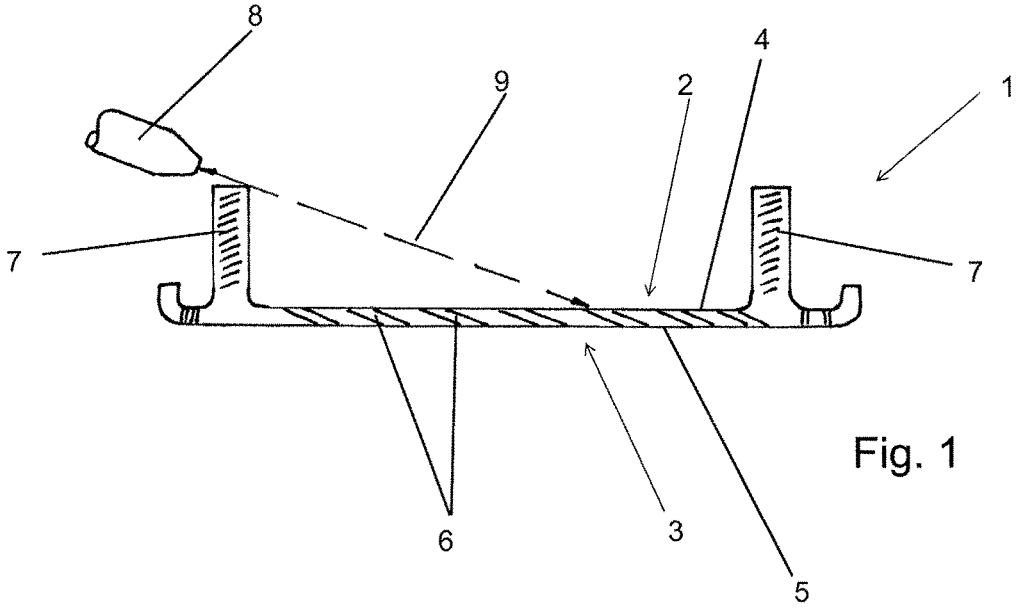
FIG. 1 (discussed above) is a schematic cross-sectional view through a prior art combustor liner element, showing a cleaning step used to clean the element's effusion holes.
Figure 2:
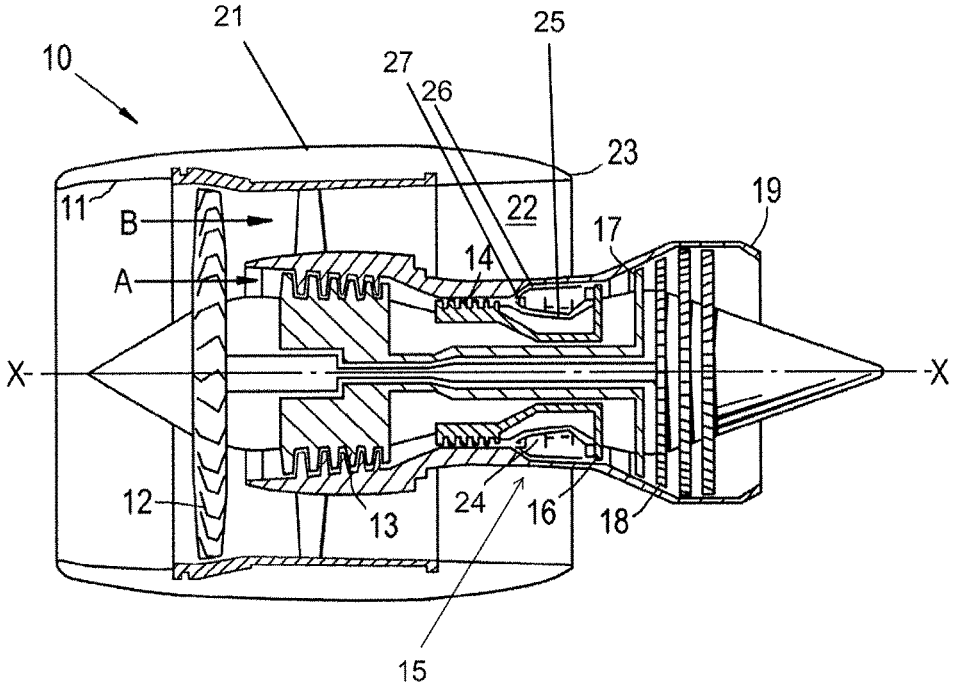
FIG. 2 is a schematic longitudinal cross-sectional view through a gas turbine engine of a type in which the present invention may be provided.

Turning now to consider FIGS. 2 to 8 of the drawings in more detail, FIG. 2 shows a ducted fan gas turbine engine 10 which incorporates the invention and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The combustion equipment 15 comprises an annular combustor 24 having radially inner and outer walls 25, 26 respectively. Fuel is directed into the combustor 24 through a number of fuel nozzles located at the upstream end 27 of the combustor. The fuel nozzles are circumferentially spaced around the engine 10 and serve to spray fuel into air derived from the high pressure compressor 14. The resultant fuel/air mixture is then combusted within the combustor 24.

The combustion process which takes place within the combustor 24 naturally generates a large amount of heat energy. It is therefore necessary to arrange that the inner and outer wall structures 25, 26 are capable of withstanding this heat while functioning in a normal manner.

Figure 3:
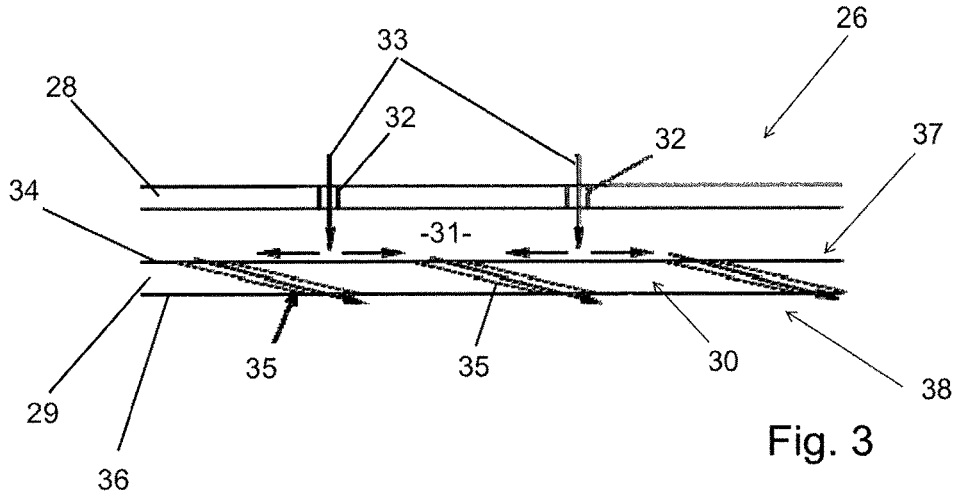
FIG. 3 is a cross-sectional view through part of the engine's combustor, the combustor having a liner element in accordance with the present invention.

A region of the radially outer wall structure 26 is shown in more detail in FIG. 3. It is to be appreciated, however, that the radially inner wall structure 25 is of the same general configuration as the radially outer wall structure 26.

Figure 4:
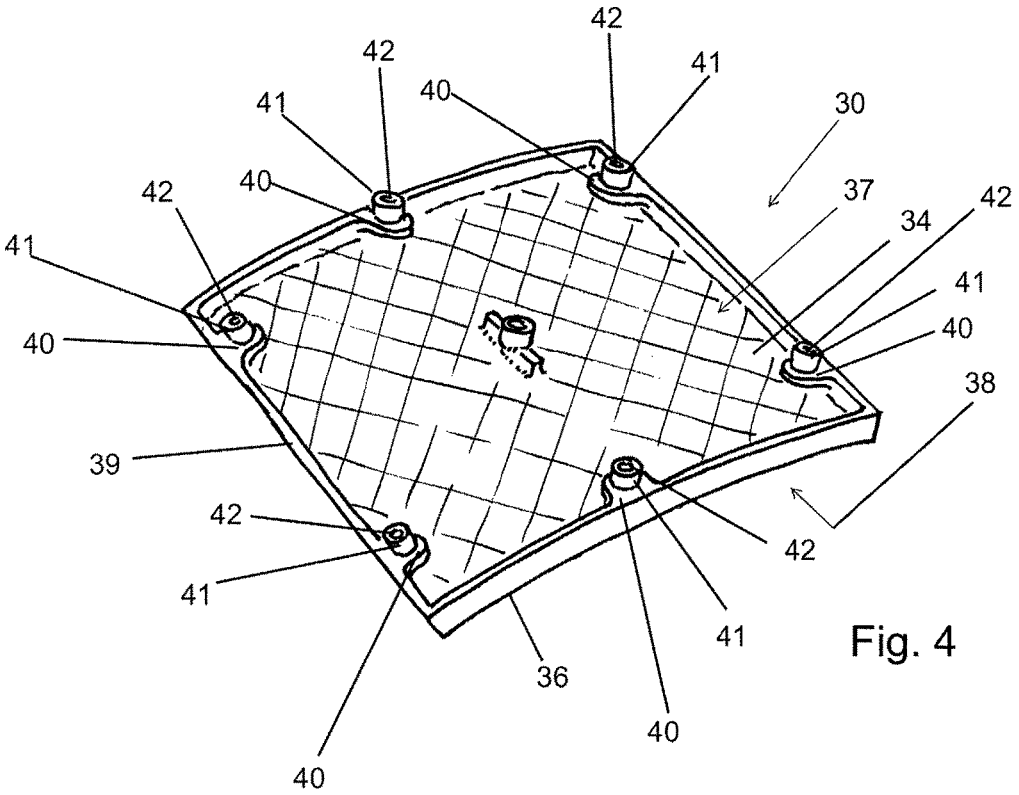
FIG. 4 is a perspective view of a liner element in accordance with the present invention, as viewed from the cooling side of the element.

Referring to FIG. 3, the radially outer wall structure 26 comprises an outer structural wall 28 and an inner wall 29. As will become apparent hereinafter, the inner wall 29 is formed from a plurality of liner elements 30, one of which is illustrated in FIG. 4, which are affixed to the outer wall 28 so as to lie adjacent one another in a tessellated manner. The liner elements 30 making up the inner wall thus each define a respective tile and collectively define a liner to the outer structural wall 28 of the combustor 24. As will become apparent, and as shown in FIG. 3, the major extent of each liner element 30 is spaced from the outer wall 28 to define a chamber 31 between the outer wall 28 and each liner element 30 in the manner of a conventional IE tile of the type described in the introduction above.

During engine operation, some of the air exhausted from the high pressure compressor 14 is permitted to flow over the exterior surfaces of the combustor 24 to provide combustor cooling, whilst some is directed into the combustor to assist in the combustion process. A large number of feed holes 32 are provided through the outer wall 28 as shown in FIG. 3, to permit the flow (illustrated schematically by arrows 33 in FIG. 3) of some of this compressor air into the chambers 31. As illustrated in FIG. 3, the air passing through the holes 32 impinges upon the radially outward surfaces 34 of the liner elements 30. This impingement of the compressor air serves to cool the liner elements 30.

The air is then exhausted from the chambers 31 though a plurality of angled effusion holes 35 provided through each liner element 30. The effusion holes 35 thus define respective flow channels through the liner element 30 having respective axes which are inclined relative to the radially outward surface 34. The effusion holes 35 are so angled as to be aligned in a generally downstream direction with regard to the general fluid flow direction through the combustor. The air exhausted from the effusion holes 35 forms a film of cooling air over the radially inward surface 36 of each liner element 30, which is the surface confronting the combustion process which takes place within the combustor 24. This film of cooling air assists in protecting the liner elements 30 from the effects of the high temperature gases within the combustor 24.

As will thus be appreciated, each liner element 30 effectively has a radially outward cooling side, indicated generally at 37 in FIG. 3, and a radially inward combustion side, indicated generally at 38 in FIG. 3. The radially outward surface 34 of each liner element, on its cooling side, can thus be considered to represent a cooling side surface. Similarly, the radially inward surface 36 of each liner element, on its combustion side, can thus be considered to represent a combustion side surface.

Turning now to consider FIG. 4, there is shown a complete liner element 30 in the form of an IE tile. The liner element 30 is illustrated as viewed from its cooling side 37, with its oppositely directed combustion side 38 facing downwardly in the orientation shown. The major extent of the liner element, in which the effusion holes 35 are provided, is shown cross-hatched in FIG. 4, the individual effusion holes not actually being shown. As will therefore be appreciated, the cooling side surface 34 is shown facing upwardly, and the combustion side surface 36 faces downwardly and so is not visible in FIG. 4.

The liner element 30 is formed from a suitable metal such as a superalloy. Suitable metals for the liner element 30 include nickel-based superalloy, cobalt-based superalloy and iron-based superalloy. The liner element 30 is preferably formed as a unitary construction via either a casting process or an additive layer manufacturing technique such as direct laser deposition. In the case of the liner element 30 being cast, then it envisaged that the effusion holes 35 will be formed after the casting process, for example by a laser cutting technique. In the event that the liner element 30 is formed by an additive layer manufacturing technique, then the effusion holes 35 can be formed simultaneously with the rest of the liner element as it is built up.

The liner element 30 has an integrally formed peripheral flange 39, which extends radially in the orientation illustrated in FIG. 4, away from the cooling side 37 of the liner element 30. The flange 39 is configured to engage the outer wall 28 of the combustor 24 when the liner element 30 is affixed to the outer wall, and thereby serves to define the perimeter of the chamber 31 defined between the outer wall 28 and the liner element 30 and to space the cooling side surface 34 from the outer wall 28 in the manner illustrated in FIG. 3.

At positions spaced around the peripheral flange 39 the flange supports respective tabs 40, each of which extends inwardly from the periphery of the liner element and which is spaced from the cooling side surface 34. Each tab 40 supports a respective integrally formed protuberance 41 which extends radially away from the cooling side surface 34 of the liner element and thus projects from the cooling side 37 of the liner element. Each protuberance is provided in the form of a short boss, having a central and internally threaded bore 42. The threaded bore 42 of each boss 41 may extend completely through the boss and its respective supporting tab 40 as illustrated in cross-section in FIG. 5 which shows a pair of such bosses 41 carried by respective adjacent liner elements 30. Alternatively, however, the bores 42 can be blind in the sense that they are open at the free ends of the respective bosses but closed at their tab ends.

In the configuration illustrated in FIG. 4 it will be seen that each boss 41 is generally cylindrical in form. Also shown in FIG. 4 is a centrally located boss 41 of generally identical form which extends rearwardly from a central region of the cooling side 37 of the liner element. This non-peripheral and centrally located boss 41 is illustrated in more detail in FIGS. 6 and 7, in which it can be seen that the boss 41 is supported by a web 43 which projects from the cooling side surface 34. It is to be appreciated that whilst the particular liner element 30 illustrated in FIG. 4 has only one non-peripheral boss 41 of this type, it is possible for a liner element 30 to have more than one such boss.

Figure 5:
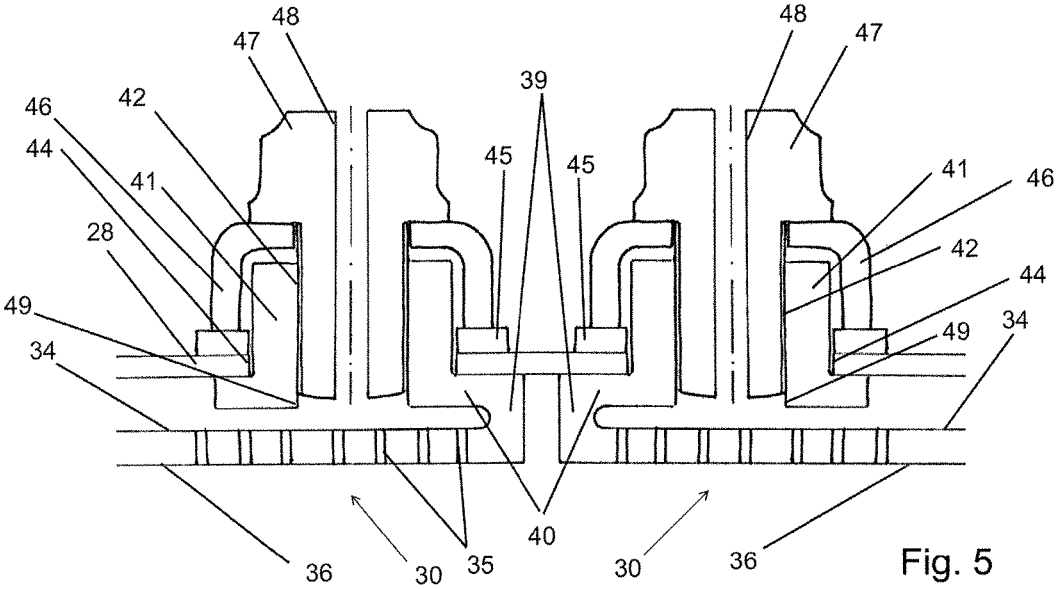
FIG. 5 is a cross-sectional view showing parts of two liner elements in accordance with the invention attached to the outer wall of a combustor.
Figure 6:
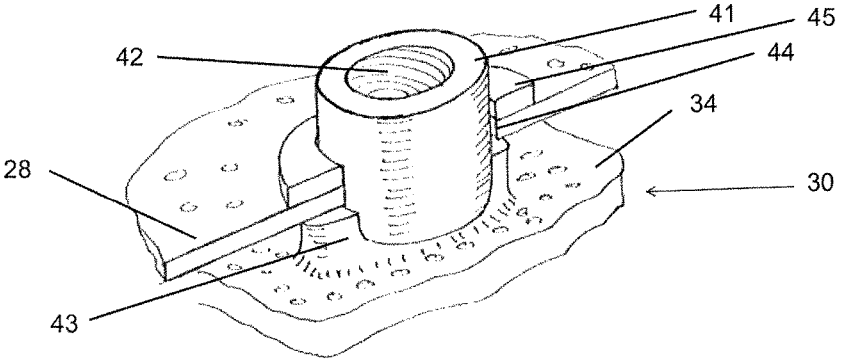
FIG. 6 is a part-sectional view showing part of a liner element in combination with the outer wall of a combustor.
Figure 7:
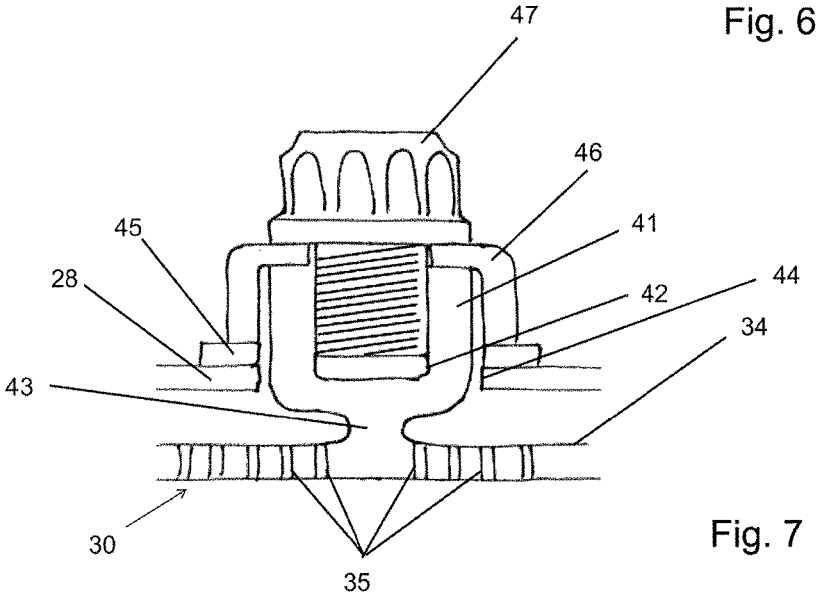
FIG. 7 is a cross-sectional view showing the part of the liner element illustrated in FIG. 6 attached to the outer wall of the combustor.

FIGS. 5, 6 and 7 show the liner element(s) 30 in combination with the outer wall 28 of the combustor, and more particularly illustrate the function of the bosses 41 in attaching the liner elements to the outer wall 28. As will be noted, each boss 41 is arranged and configured to engage the outer wall 28, and more particularly to be received and engaged within and to extend through a respective fixing aperture 44 provided through the outer wall 28.

In order to affix a liner element 30 to the outer wall 28 of the combustor, the liner element 30 is offered up to the radially inward side of the outer wall 28, with its bosses 41 aligned with respective fixing apertures 44. The bosses 41 are then inserted through the fixing apertures and the liner element 30 is pressed towards the outer wall 28 until its peripheral flange (not shown in FIGS. 6 and 7) engages the radially inward surface of the outer wall 28. It is to be noted in this regard that the tabs 40, from which the bosses 41 project, also engage the radially inward surface of the outer wall 28. Similarly each web 43, from which a centrally located boss 41 projects, also engages the radially inward surface of the outer wall 28. In this position the bosses 41 each extend through the fixing apertures 44 and protrude from the opposite side. A sealing washer 45 may then be fitted over each boss 41, from the radially outward side of the combustor wall 28, followed by a cupped spacer washer 46. The cupped spaced washers 46 each bear against a respective sealing washer 45 and extend inwardly over the end of a respective boss 41. A respective externally threaded bolt 47 may then be threadedly engaged within the threaded bore 42 of each boss 41 and drawn up tight to securely fix the liner element 30 to the combustor's outer wall 28.

As illustrated in FIG. 5, at least some of the threaded bolts 47 which are used to engage respective bosses 41 in order to fix the liner element 30 to the outer wall 28 of the combustor may each have a centrally located airflow passage 48. The airflow passages 48 of the two bolts 47 shown in FIG. 5 extend the full length of the bolts 47 and are thus open at the radially outermost ends of the bolts 47 and also at the radially innermost ends of the bolts 47. These airflow passages 48 may serve a similar function to the feed holes 32 in the outer wall 28 of the combustor by permitting a flow of cooling air drawn from the engine's high pressure compressor 14 through the bolts 47 for impingement on the cooling side surface 34 of the liner element 30 in the region of the bosses 41. Additionally, the flow of cooling air through the airflow passages 48 in the bolts 47 will also serve to cool the bolts 47 themselves, and to a degree also the bosses 41. It is envisaged that bolts 47 of this configuration will be used most conveniently to engage the peripheral bosses 41 which protrude from the flange tabs 40, and so it is proposed that the flange tabs 40 will have respective openings 49 to permit exit of the cooling air from the airflow passages 48 in the bolts 47. As will thus be appreciated, the flow of cooling air through the bolts 47 may also serve to cool the flanges 40.

Because the bosses 41 are each internally threaded and configured to receive a respective bolt 47, rather than externally threaded for engagement by a nut, they can be configured to be significantly shorter than the externally threaded studs 7 used in the prior art IE tiles. This is because the bosses 41 do not need to project through the fixing apertures 44 as far as the externally threaded studs of the prior art. Indeed, whilst the embodiment illustrated is configured such that the bosses 41 extend through the fixing apertures, it is envisaged that in some embodiments they could instead bear against the surface of the combustor outer wall 28 around respective fixing apertures which would permit the bosses 41 to be even shorter than those illustrated.

Figure 8:
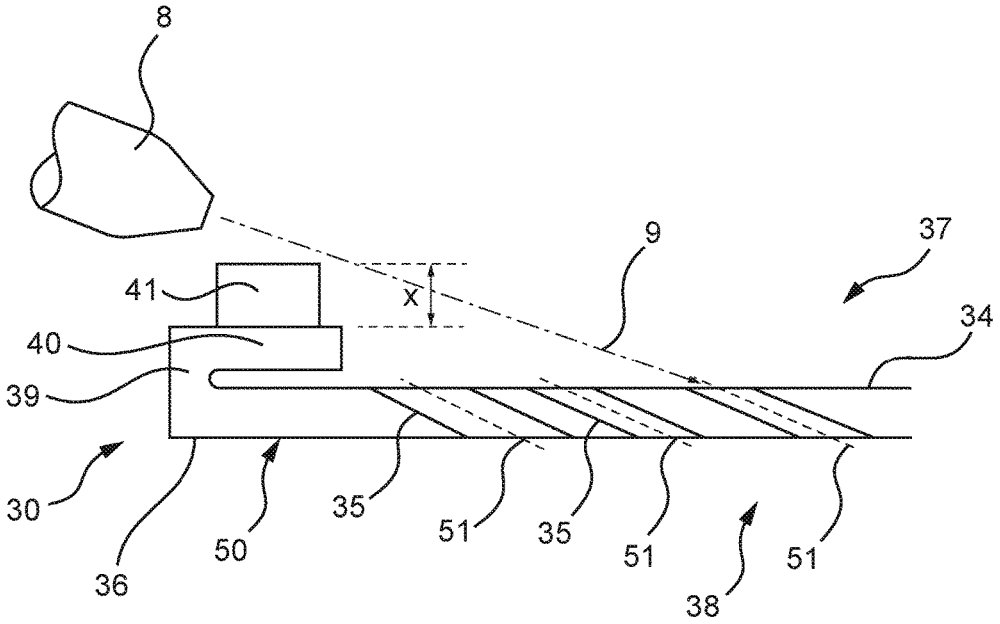
FIG. 8 is a cross-sectional view similar to that of FIG. 1, but which shows part of a liner element in accordance with the present invention being subjected to a cleaning step to clean the element's effusion holes.

The lower profile of the bosses 41, in comparison to the externally threaded studs of the prior art, is shown most clearly in FIG. 8. It is envisaged that the peripheral bosses 41 around the flange 39 may be configured such that they protrude from the flange by a distance x of only 2 to 8 mm, and optionally approximately 5 mm. The shorter configuration of the bosses 41 offers a significant advantage when applying a thermal barrier coating to the combustion side surface 36 of the liner element 30 by the so-called "drill-coat-clean" method described above, as will now be explained below.

FIG. 8 depicts the liner element 30 after it has had a thermal barrier coating 50 applied to its combustion side surface 36, which may be achieved by any convenient known process such as air plasma spraying. As will be appreciated from the foregoing, it is thus necessary then to clean the effusion holes 35 to remove any coating material that may have become deposited within the effusion holes during the coating step and which may thus block the holes. This is achieved by a cleaning step which uses a similar jetting process to that described above in connection with the prior art, and FIG. 8 thus illustrates a jet nozzle 8 positioned on the cooling side 37 of the liner element 30 and which is oriented to direct a jet of cleaning water or air along a jet axis 9 towards and through the effusion holes 35 from the cooling side 37 of the liner element. As will be noted, the nozzle 8 is oriented so that the jet axis 9 is substantially parallel to the axes 50 of the flow channels defined by the effusion holes 35. The nozzle 8 will be moved across the cooling side 37 of the liner element 30 in spaced relation to the cooling side surface 34, in order to direct the jet through all, or as many as possible, of the effusion holes 35.

Because of the bosses 41 protruding from the cooling side 37 of the liner element 30 are relatively short as explained above, and hence have a low profile as viewed in cross-section in FIG. 8, the nozzle 8 can be moved across the cooling side 37 of the liner element in this manner at a much closer spacing from the cooling side surface 34 than in the case of the prior art, without being obstructed by the fixing bosses 41. In particular, with the bosses 41 configured as described above, the nozzle can be maintained at a distance of less than or equal to 30 mm from the cooling side surface 34 as measured along the jet axis 9 throughout the cleaning procedure and without fouling or clashing with the bosses 41. The closer range of the cleaning nozzle 8 thus permits significantly improved cleaning of the effusion holes 35.

Furthermore, the shorter configuration of the fixing bosses 41 also means that there will be fewer effusion holes 35 proximate the bosses 41 which fall into the "shadow" of the bosses 41 (such as the leftmost effusion holes shown in FIG. 8) and which cannot be targeted so effectively by the cleaning jet. Nevertheless there may still remain some effusion holes 35 proximate the bosses 41 which may not be conveniently targeted by the cleaning jet in the orientation illustrated, and so it is proposed that some of these effusion holes could be made larger than other more easily targeted holes distal to the bosses 41, thereby permitting more variation in the jetting angle used to clean the holes in these regions, and also reducing the likelihood of the thermal barrier coating material completely blocking them.

In the case that the liner elements 30 are made via an additive layer manufacturing technique such as direct laser deposition, then the effusion holes 35 will be formed simultaneously with the rest of the liner element. In the case that the liner elements 30 are cast, then of course the effusion holes will need to be drilled before the thermal barrier coating is applied.

In the case of the liner elements 30 being made by an additive layer manufacturing method then the shorter length of the fixing bosses 41 also permits more efficient production of the liner elements 30 because they permit a larger number of liner elements 30 to be formed simultaneously in a vertically stacked array, thereby obviating another problem associated with the prior art.

As will also be noted, each boss 41 projecting from a supporting tab 40 on the peripheral flange 39, and each centrally located boss 41 projecting from a supporting web 43 is spaced from the cooling side surface 34 of the liner element 30. It is thus possible to provide effusion holes 35 through the liner element 30 at positions underneath (and thus radially inwardly of) the tabs 40 and their respective bolts 47 and/or at the sides of the webs 43 and underneath (and thus radially inwardly of) their respective bolts 47.

Whilst the invention has been described above with reference to specific embodiments, it is to be appreciated that various modifications can be made without departing from the scope of the present invention. For example, whilst the liner element 30 described above and shown in the drawings has only internally threaded bosses 41 and no externally threaded studs 7 such as those of the prior art, embodiments are envisaged which could have a mixture of both. Having regard to FIG. 8, which shows the angled effusion holes 35 being arranged to direct a flow of air from the cooling side 37 to the combustion side 38 of the liner element and in a generally downstream direction with regard to the general fluid flow direction though a combustor, it will be appreciated that the liner element 30 could have conventional fixing studs 7 provided at its downstream end without adversely affecting the cleaning process as described above. It is therefore possible for the liner element 30 to have conventional fixing studs 7 along its downstream edge, but internally threaded bosses 41 of the type described herein elsewhere. As will be appreciated, however, given the problems described above in relation to forming conventional fixing studs 7 by a direct laser deposition process, it is envisaged that a liner element 30 of this configuration would be cast.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A liner element for a gas turbine combustor having a structural wall, the liner element comprising:

a unitary construction defining a cooling side and a combustion side;

a plurality of effusion holes extending between a cooling side surface of the liner element and a combustion side surface of the liner element;

a peripheral flange configured to engage said structural wall of the gas turbine combustor when the liner element is affixed to the structural wall with a cooling side surface of the liner element spaced from the structural wall to define a chamber between the cooling side surface and the structural wall; and protuberances that are internally threaded, each protuberance being positioned at the cooling side and supported by (1) the peripheral flange or (2) at least one centrally located web projecting from the cooling side surface so that the protuberances are spaced from the cooling side surface, the protuberances being arranged to engage the structural wall.

2. The liner element according to claim 1, wherein each of the protuberances is provided in the form of a boss projecting from the cooling side of the liner element.

3. The liner element according to claim 1, wherein said protuberances projecting from the flange protrude by a distance of between 2 mm and 8 mm.

4. The liner element according to claim 1, wherein said protuberances projecting from the flange protrude by a distance of approximately 5 mm.

5. The liner element according to claim 1, wherein the peripheral flange supports at least one tab, each tab extending inwardly from the periphery of the liner element towards a center of the liner element, each tab being spaced from the cooling side surface and each tab supporting one of the protuberances which extends away from the cooling side surface of the liner element.

6. The liner element according to claim 1, wherein the plurality of effusion holes define respective flow channels through the liner element having respective axes which are inclined relative to said combustion side surface.

7. The liner element according to claim 1, wherein some of the plurality of effusion holes are proximate to said protuberances and are larger than other effusion holes of the plurality of effusion holes which are distal to said protuberances.

8. The liner element according to claim 1, wherein some of the plurality of effusion holes are provided underneath at least one of the protuberances.

9. The liner element according to claim 8, wherein the plurality of effusion holes having respective axes which are arranged perpendicularly to said combustion side surface.

10. The liner element according to claim 1 provided in combination with the gas turbine combustor, wherein the liner element is affixed to the structural wall of the combustor by a plurality of threaded bolts, each bolt of the plurality of threaded bolts extending through a respective fixing aperture formed in the structural wall and threadedly engaging a respective protuberance of the protuberances.

11. The liner element provided in combination with the gas turbine combustor according to claim 10, wherein each protuberance of the protuberances is engaged within a respective said fixing aperture.

12. The liner element provided in combination with the gas turbine combustor according to claim 10, wherein each protuberance of the protuberances projects through a respective said fixing aperture.

13. The liner element provided in combination with the gas turbine combustor according to claim 10, wherein at least one threaded bolt of the plurality of threaded bolts has a centrally located passage, the centrally located passage extends the full length of the threaded bolt and the corresponding protuberance has a bore which extends completely though the corresponding protuberance.

14. A gas turbine combustor comprising:

a structural wall; and a liner element including:

a unitary construction defining a cooling side and a combustion side, a plurality of effusion holes extending between a cooling side surface of the liner element and a combustion side surface of the liner element, a peripheral flange engaging the structural wall with the cooling side surface spaced from the structural wall to define a chamber between the cooling side surface and the structural wall, and protuberances that are internally threaded, each protuberance being positioned at the cooling side and supported by (1) the peripheral flange or (2) at least one centrally located web projecting from the cooling side surface so that the protuberances are spaced from the cooling side surface, the protuberances being arranged to engage the structural wall; and a plurality of threaded bolts affixing the liner element to the structural wall, each of the plurality of threaded bolts extending through a respective fixing aperture formed in the structural wall and threadedly engaging a respective protuberance of the protuberances.

15. The gas turbine engine combustor as claimed in claim 14, wherein some of said effusion holes are provided underneath at least one protuberance of the protuberances, the at least one protuberance has a bore which extends completely though the protuberance, and a corresponding threaded bolt of the plurality of threaded bolts has a centrally located passage and the centrally located passage extends the full length of the corresponding threaded bolt.

16. A gas turbine combustor comprising:

a structural wall;

a liner element including:

a unitary construction defining a cooling side and a combustion side, a plurality of effusion holes extending between a cooling side surface of the liner element and a combustion side surface of the liner element, a peripheral flange engaging the structural wall with the cooling side surface spaced from the structural wall to define a chamber between the cooling side surface and the structural wall, protuberances that are internally threaded, each protuberance being positioned at the cooling side and supported by the peripheral flange so that the protuberances are spaced from the cooling side surface, the protuberances being arranged to engage the structural wall, a central protuberance, and at least one centrally located web projecting from said cooling side surface, the at least one centrally located web supporting the central protuberance; and a plurality of threaded bolts affixing the liner element to the structural wall, each of the plurality of threaded bolts extending through a respective fixing aperture formed in the structural wall and threadedly engaging a respective protuberance of the protuberances.

17. The gas turbine engine combustor as claimed in claim 16, wherein some of said effusion holes are provided underneath at least one protuberance of the protuberances, the at least one protuberance has a bore which extends completely though the at least one protuberance, and a corresponding threaded bolt of the plurality of threaded bolts has a centrally located passage and the centrally located passage extends the full length of the corresponding threaded bolt.

18. The gas turbine engine combustor as claimed in claim 16, wherein the at least one centrally located web is configured to engage said structural wall of the combustor when the liner element is affixed thereto.

* * * * *